US006293266B1

(12) United States Patent
Oetting

(10) Patent No.: US 6,293,266 B1
(45) Date of Patent: Sep. 25, 2001

(54) EXHAUST GAS RECIRCULATION DEVICE

(75) Inventor: Hermann Oetting, Braunschweig (DE)

(73) Assignee: A. Kayser Automotive Systems GmbH, Einbeck (DE)

( * ) Notice: Subject to any disclaimer, the term of this patent is extended or adjusted under 35 U.S.C. 154(b) by 0 days.

(21) Appl. No.: 09/448,777

(22) Filed: Nov. 24, 1999

Related U.S. Application Data

(63) Continuation of application No. PCT/EP98/03092, filed on May 26, 1998.

(51) Int. Cl.[7] ..... F02M 25/07

(52) U.S. Cl. ..... 123/568.21; 123/568.2; 123/568.26

(58) Field of Search ..... 123/568.11, 568.12, 123/568.17, 568.18, 568.2, 568.21, 568.26, 568.27, 568.28, 568.29, 568.3, 568.31; 60/605.2

(56) References Cited

U.S. PATENT DOCUMENTS

| | | | | |
|---|---|---|---|---|
| 3,105,477 | | 10/1963 | Lowther | 123/574 |
| 3,507,260 | | 4/1970 | Walker | 123/568.17 |
| 3,844,260 | | 10/1974 | Scott, Jr. et al. | 123/568.29 |
| 4,027,638 | * | 6/1977 | Moriya et al. | 123/568.2 |
| 4,463,740 | | 8/1984 | Sagisaka et al. | 123/568.15 |
| 5,163,295 | | 11/1992 | Bradshaw | 60/605.2 |
| 5,701,874 | * | 12/1997 | Sari et al. | 123/568.26 |
| 5,927,257 | * | 7/1999 | Hackett | 123/568.26 |
| 5,975,064 | * | 11/1999 | Krimmer et al. | 123/568.18 |

FOREIGN PATENT DOCUMENTS

| | | |
|---|---|---|
| 24 61 989 | 8/1975 | (DE) . |
| 43 34 370 | 9/1994 | (DE) . |
| 2 079 363 | 2/1982 | (GB) . |
| 06147025 | 5/1994 | (JP) . |

* cited by examiner

*Primary Examiner*—Willis R. Wolfe
(74) *Attorney, Agent, or Firm*—Anthony J. Casella; Gerald E. Hespos

(57) ABSTRACT

An exhaust gas recirculation device for recirculating exhaust gas into a gas feed to engines, especially motor vehicle engines, having an exhaust gas feed, a fresh gas feed and an outlet duct opening into the gas feed, where at least the exhaust gas feed and the fresh gas feed are interconnected via a control means for metering exhaust gas and, on the side of the control means facing the fresh gas feed, there is arranged a pressure plate which minimizes the influence of pressure fluctuations that occur on the exhaust gas side and the fresh gas side and have an effect on the exhaust gas throughput.

11 Claims, 15 Drawing Sheets

EXHAUST GAS RECIRCULATION DEVICE

This application is a continuation of PCT/EP98/03092 filed May 26,1998 with the United States as a designated country.

BACKGROUND OF THE INVENTION

1. Field of the Invention

The invention relates to an exhaust gas recirculation device with pressure compensation.

2. Description of the Related Art

Spark-ignition and diesel engines, especially those in motor vehicles, are usually provided with exhaust gas recirculation devices, especially exhaust gas recirculation valves (EGR valves). By means of the latter, exhaust gas is to some extent mixed with the fresh gas taken in, in order to reduce the NOx emission and to improve the fuel consumption, and to reduce the production of noise.

Such exhaust gas recirculation devices comprise metering means or control means with which the quantity of exhaust gas recycled can be set as a function of the operating point. Too little exhaust gas recirculation would not achieve the desired effects, too high exhaust gas recirculation in spark-ignition engines would lead to disruption of the operation or to an undesired rise in HC or even CO emissions and, in the case of diesel engines, would lead to an undesired increase in the particulate emissions.

Such control means are generally valves which can be closed completely and which are set by a vacuum diaphragm or an actuating motor or a proportional magnet operating counter to a spring, said means in turn being actuated by the controller of the engine via a cycling valve or a relay. The information used for this purpose in the controller is generally that relating to the load and rotational speed of the engine and to the quantity of air taken in. In order to improve the operation, use is also made of the feedback of the opening travel via a distance-measuring system.

The exhaust gas recirculation devices are located between the fluctuating pressures in the exhaust gas system and the fluctuation pressures in the intake system of the engine, the changes in these pressures on the one hand being associated with the changes in the operating point, and on the other hand being determined by the surge-like emergence of the exhaust gas and from the surge-like intake of the fresh air.

These pressure fluctuations constitute a problem for the metering function of the exhaust gas recirculation device in normally-aspirated engines, and are particularly serious in supercharged engines.

JP 06 147 025 (Patent Abstracts of Japan) shows an exhaust gas recirculation device such as is described in the preamble of claim 1. In this case exhaust gas from an internal combustion engine is fed to a dual valve via two exhaust gas feeds. The dual valve comprises two valve disks which are rigidly fixed to a valve rod and which in each case separate the exhaust gas feeds from a common exhaust gas recirculation duct, it being necessary for one valve disk to be moved in order to open the valve along the exhaust gas flow direction and for the other valve disk to be moved in the direction opposite the exhaust gas flow direction.

The object of the invention is to provide an exhaust gas recirculation device in which the quantity of exhaust gas which is passed through or metered is as far as possible independent of the above pressure fluctuations acting on the exhaust gas recirculation device.

SUMMARY OF THE INVENTION

An exhaust gas recirculation device according to the invention for recirculating exhaust gas into a gas feed to engines, especially motor vehicle engines, comprises an exhaust gas feed, a fresh gas feed and an outlet duct opening into the gas feed, where at least the exhaust gas feed and the fresh gas feed are interconnected via a metering or control means and, on the side of the control means facing the fresh gas feed, there is arranged a pressure plate which minimizes and preferably eliminates the influence of pressure fluctuations that occur on the exhaust gas side and the fresh gas side and have an effect on the exhaust gas throughput.

If the control means, which can be formed in particular by a valve or main valve, is in a partially or completely opened position, exhaust gas can flow from the exhaust gas side of the exhaust gas recirculation device in the direction of the fresh gas side. The pressure plate is arranged in the gas or exhaust gas stream in the exhaust gas recirculation device in such a way that it forms a flow resistance for the exhaust gas stream flowing around it or through it and thus, as the exhaust gas flows through from the exhaust gas side in the direction of the fresh gas side, leads to partial backing up or an increase in pressure of the exhaust gas stream. In this case, therefore, the gas pressure in a chamber between the control means and the pressure plate is greater than in a chamber which is arranged on the fresh gas side of the pressure plate. The difference between these gas pressures, acting on the pressure plate on the fresh gas side and exhaust gas side, results in a force which acts on the pressure plate. This force, acting on the pressure plate, is used in accordance with the invention to influence or control the position or the free opening cross section of the control means, so that, for example, the free opening cross section of the control means is reduced when a force on the pressure plate directed in the direction of the fresh gas side or in the closing direction of the control means increases. The pressure plate can therefore be designed in such a way that an increase in the pressure drop between the exhaust gas side and the fresh gas side of the exhaust gas recirculation device leads to a predetermined decrease in the free opening cross section of the control means, and a decrease in this pressure drop leads to a predetermined increase in the free opening cross section of the control means.

In this way, the influence of fluctuations or variations of the gas pressure on the exhaust gas side and fresh gas side in the exhaust gas recirculation device on the throughput or the metering of the recirculated exhaust gas or on the proportion of exhaust gas in the gas stream in the outlet duct can be minimized and preferably completely eliminated.

According to a preferred embodiment of the invention, the control means is connected to a mechanical, pneumatic, hydraulic, magnetic or electric actuating device or actuating motor. The use of a magnet or proportional magnet has proven to be particularly advantageous, since using such a device the opening or position of the control means can be set very accurately and, above all, it reacts very quickly.

According to a further preferred embodiment, the exhaust gas recirculation device is provided with a compensation device, which is used for the compensation or balancing of forces which act on the control means as a result of a difference between the gas pressure on the exhaust gas side and fresh gas side. Because of this compensation device, the pressure drop of the gas pressure across the control means cannot lead to a force component which acts in the direction of the undesired opening or closing of the control means, as a result of which the desired control or regulation of the quantity of exhaust gas passed through is considerably improved. The compensation device used can, in particular, be a second valve disk or piston, diaphragms and/or bellows.

In this case, it is advantageous to load the compensation device on one side with the gas pressure on the exhaust gas side, that is to say the gas pressure prevailing in the exhaust gas feed, and to load the other side with the gas pressure on the fresh gas side, that is to say the gas pressure prevailing on the fresh gas side of the control means and thus between the main valve and pressure plate. The resulting pressure difference across the compensation device results in a force component which is directed counter to the force component to be compensated for, has the same magnitude and thus has the effect of balancing the two force components.

According to a further preferred embodiment, the compensation device is provided with a kinematic transmission, especially a lever transmission. This transmission converts the force component produced by the compensation device to a magnitude which is suitable for the compensation of the force to be compensated for on the control means. This is particularly advantageous when the areas or area contents which are effective for the gas pressures, in the compensation device and control means, are different.

According to a further preferred embodiment, the compensation device, the control means and the pressure plate are interconnected in terms of the action of force and are controllable via the activating device. In this way, the forces produced by the compensation device, the pressure plate and by the actuating device can act together on the control means and add up or compensate each other in a suitable way, in order to exert the desired net force or force component on the control means.

According to a further preferred embodiment, it has proven to be advantageous to provide a stationary impact-pressure plate, in order to prevent an exhaust gas stream flowing out of the control means from flowing directly onto the pressure plate. The action of an undesired impact-pressure component on the pressure plate can be eliminated in this way. For this purpose, the impact-pressure plate is typically arranged in such a way that the exhaust gas stream flowing out of the control means does not flow directly onto the pressure plate, that is to say no undesired transfer of momentum from the inflowing exhaust gas stream onto the pressure plate takes place.

According to a further preferred embodiment, the control means is prestressed in the closed direction by the spring action of a diaphragm or a bellows, it being possible, in particular, for a spring to be provided as well to assist the prestressing, in order to provide an additional force component in the closed direction of the control means.

The pressure plate can advantageously be arranged and designed in such a way that the gas or exhaust gas essentially flows through exactly defined openings in the pressure plate, and as little gas as possible can get around the outer circumference of said pressure plate, that is to say little gas can flow between the pressure plate and a wall adjacent thereto, but instead the gas stream is led through openings designed for this purpose in the pressure plate itself. In this case, these openings are in particular matched from acoustic, fluidic and mechanical points of view.

Moreover, a design of the pressure plate is possible in which the latter is equipped with additional devices, so that, in the case of a small gas pressure drop or small pressure differences between gas pressures on the pressure plate on the exhaust gas side and fresh gas side, the exhaust gas can flow around the outer circumference of the pressure plate, but, in the case of increasing or greater pressure differences, additional gas passage openings are opened, through which the gas stream can additionally flow. By this means, an additional and advantageous degree of freedom is provided for the purpose of matching from acoustic, fluidic and mechanical points of view.

An exhaust gas recirculation device is preferred in which a gas pressure in an inner valve compensation chamber is controlled by the interaction of an inner valve with an opening gap between the piston and a guide sleeve of the piston, the inner valve being actuated by the actuating device and/or an additional inner-valve actuating device. The selection of the diameter of the piston relative to that of the control means, for example of the main valve, also influences the matching of the inner valve to the opening gap between the piston and the guide sleeve.

BRIEF DESCRIPTION OF THE DRAWINGS

The invention will be described in more detail below by way of example with reference to preferred embodiments. In the drawings.

DETAILED DESCRIPTION OF THE PREFERRED EMBODIMENTS

In the following text, all identical or essentially identical features of the various embodiments are provided with uniform reference symbols, for reasons of simpler representation.

Figure 1:
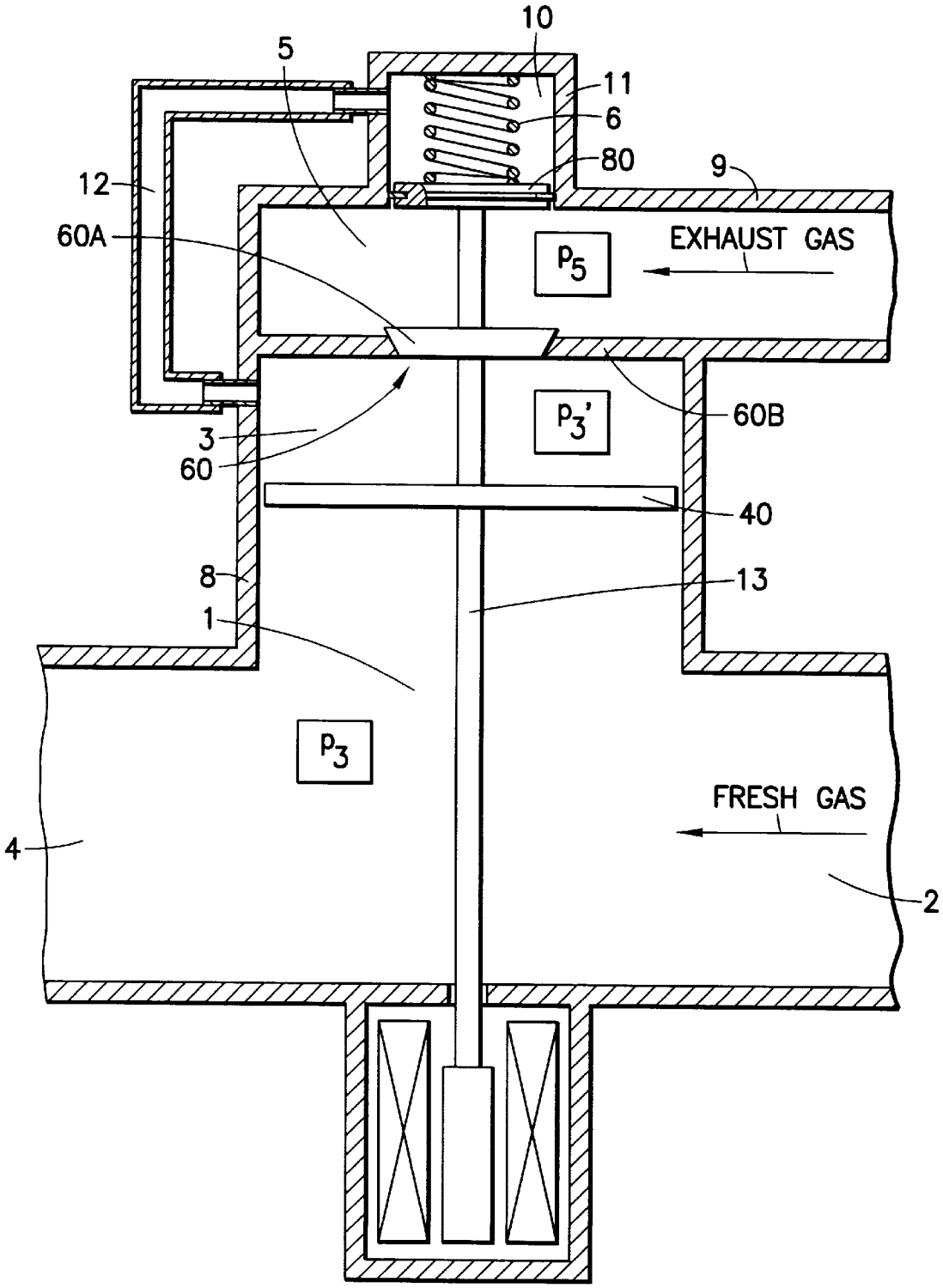
FIG. 1 shows a schematic cross-sectional illustration of an exhaust gas recirculation device according to the invention having a pressure compensation line.

FIG. 1 shows in schematic form a cross section of a first embodiment of the exhaust gas recirculation device according to the invention. The exhaust gas is fed to the exhaust gas recirculation device by means of an exhaust gas duct or exhaust gas feed 5, one side of which opens into the main exhaust gas stream of the engine. The exhaust gas feed 5 is connected to a chamber 3 via a valve or main valve 60, which comprises a valve disk 60A and a valve seat or wall 60B. On the fresh gas side, the chamber 3 is partially closed by a pressure plate 40, which constitutes a flow resistance for gas or exhaust gas. Gas passage openings (not illustrated) from the chamber 3 into a junction 1 can be formed between the outer circumference of the pressure plate 40 and a wall 8 or in the pressure plate 40 itself. The junction 1 of the recirculated exhaust gas stream is connected to a fresh gas feed 2 and an outlet duct 4, which passes on the fresh gases to which exhaust gas has been added.

Provided in an upper wall 9 of the exhaust gas feed 5 is a compensation chamber or piston chamber 10 to accommodate a compensation piston or balancing piston or piston 80. The circumference of the piston 80 rests on a wall or side wall 11 and is connected to an upper part of the wall 11 via a spring or spiral spring 6. The piston chamber 10 is connected to the chamber 3, via a line or balancing line 12, in such a way that the gas pressures in the piston chamber 10 and the chamber 3 can be balanced rapidly.

Piston 80, valves 60A and pressure plate 40 are interconnected in this order by a rod 13. Arranged on a side of the rod 13 opposite the piston 80 is an actuating device in the form of an electromagnet or proportional magnet 14, via which the main valve 60 can be controlled or regulated.

The gas pressure in the junction 1 of the recirculated exhaust gas stream into the fresh gas is $p_3$ under operating conditions, the gas pressure $p_3'$ prevails in the chamber 3 between the valve disk 60A and pressure plate 40, and the gas pressure $p_5$ is present in the exhaust gas feed 5. At all the operating points of a normally-aspirated engine which are relevant to exhaust gas recirculation, it is true that $p_5>p_3$. A positive, that is to say reversed, flushing pressure gradient $p_5<p_3$ can occur under certain circumstances, given supercharging of the engine effected by mechanical means or by a turbocharger.

Because of the flow resistance connected to the pressure plate 40, when the main valve 60 is open there is an increase in the gas pressure $p_3'$ in the chamber 3 with respect to the gas pressure $p_3$ in the junction 1. It is therefore true that $p_5>p_3'>p_3$.

When the exhaust gas recirculation or main valve 60 is open, the exhaust gas will therefore as a rule flow in the desired direction, that is to say from the exhaust gas feed 5 in the direction of the junction 1. The quantity of exhaust gas passed through in this case essentially depends on the opening cross section of the main valve and on the gas pressure gradient across the main valve 60, that is to say on the pressure difference $p_5-p_3'$.

In order to minimize the influence of this pressure gradient or this pressure difference $p_5-p_3$ or $p_5-p_3'$ on the quantity of exhaust gas passed through, use is made of the pressure plate 40. By means of suitable selection of the shape and diameter of the pressure plate 40, and configuration of the gas passage from the chamber 3 to the junction 1 between a chamber wall or wall 8 and the outer circumference of the pressure plate 40 and/or through the pressure plate 40, it is possible to achieve the situation in which, when the pressure gradient $p_5-p_3$ increases or decreases, the free opening cross section of the main valve 60, that is to say the opening cross section between the valve disk 60A and the valve seat 60B, is decreased or increased by precisely an amount such that the quantity of recirculated exhaust gas passed through does not change with the above-mentioned pressure fluctuations or changes in the pressure difference, and has a magnitude which can be determined or predetermined, or such that the proportion of exhaust gas in the outlet duct 4 downstream of the junction 1 remains constant and has a magnitude which can be determined or predetermined. The throughput of the quantity of recirculated exhaust gas is therefore essentially independent of the fluctuations or variations of the gas pressure ($p_5$ and $p_3$) on the exhaust gas recirculation device on the fresh gas side and exhaust gas side, that is to say is essentially independent of changes in the gas-pressure difference or the pressure gradient $p_5-p_3$.

In order to make the quantity of recirculated exhaust gas which is passed through independent to the greatest extent of the pressure gradient $p_5-p_3$ by means of such a configuration of the pressure plate 40 and of the gas passage at the latter, it is advantageous to compensate for the force contribution of the force acting in the rod 13 on the basis of the pressure gradient $p_5-p_3'$, in order that this force contribution does not lead to any undesired opening or closing of the main valve 60, which would make the desired control or regulation of the exhaust gas throughput, using the pressure plate 40, more difficult.

In this case, this force acting in the rod 13 depends to a great extent on the pressure gradient $p_5-p_3'$ across the main valve 60. When the main valve 60 is closed, without the piston 80 and without the line 12, the force which acts in the rod 13 is that which results from the pressure gradient $p_5$ and $p_3$ and a cross-sectional area or a cross section $F_3$ of the valve disk 60A. To a first approximation, when the valve is open the force acting in the rod 13 is given by $$(p_5-p_3')\times F_3+(p_3'-p_3)\times F_4+C_6\times S_6$$

where $F_4$ is an effective cross-sectional area of the pressure plate 40 and $C_6$ denotes the spring constant of the spring 6 and $S_6$ its deflection from the equilibrium position. In this case, the magnet or proportional magnet 14 initially exerts no force on the rod 13.

The force $$(p_5-p_3')\times F_3$$

is compensated for by the piston 80, which has the same effective area or area of action $F_3$ for the gas pressure as the valve disk 60A. On the piston 80 there therefore acts a force which is directed opposite to the force on the valve disk 60A and has the same magnitude.

The actuation of the main valve 60 of the exhaust gas recirculation device is preferably essentially achieved by the electric proportional magnet 14 via the rod 13, the force in the proportional magnet 14 depending only on the coil current and not on the position of the armature. Such an arrangement has the advantage that it can react quickly and can set a valve stroke or opening of the valve 60 very accurately. However, it is likewise possible to combine other means of actuating the main valve 60, such as mechanical, pneumatic, hydraulic and electric-motor means, with the pressure compensation described.

Figure 1A:
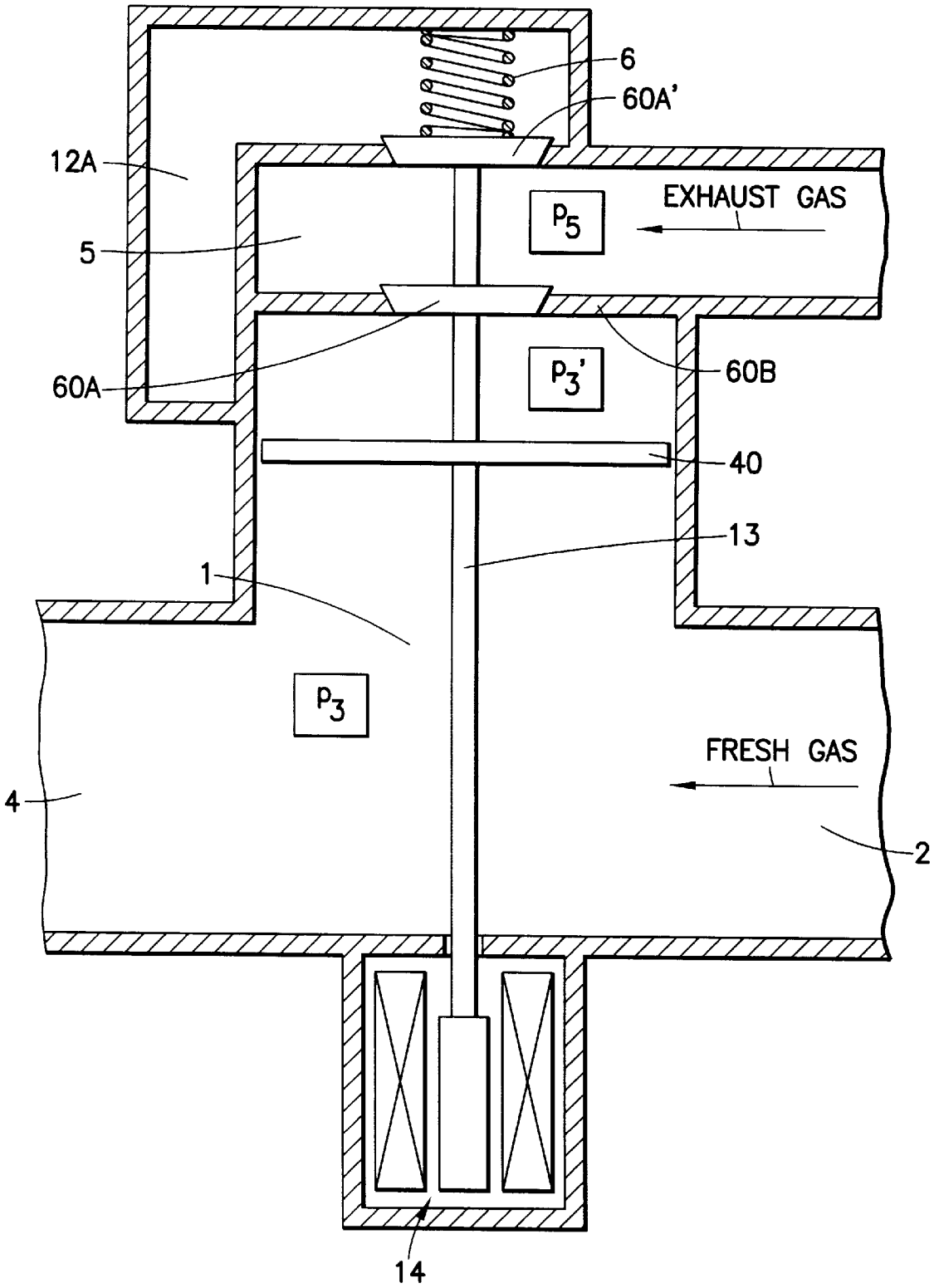
FIG. 1A shows a schematic cross-sectional illustration of a further embodiment of the invention having a pressure compensation line carrying exhaust gas and a dual valve.

FIG. 1A shows a further embodiment of the invention, in which a further possibility for compensating for the force $(p_5-p_3')\times F_3$ acting in the rod 13 consists in providing a second valve disk 60A' with a preferably slightly greater diameter than the valve disk 60A, in order to compensate for the force acting on the valve 60A exactly. This valve disk 60A makes it necessary to have a compensation line 12A which carries exhaust gas into the chamber 3 and is therefore adequately dimensioned.

Further possibilities for compensating for the force $(p_5-p_3')\times F_3$ acting in the rod 13 consist in using valves or main valves which open in an identical or virtually identical way and simultaneously or virtually simultaneously in the direction of the exhaust gas stream and in the opposite direction thereto.

Figure 2:
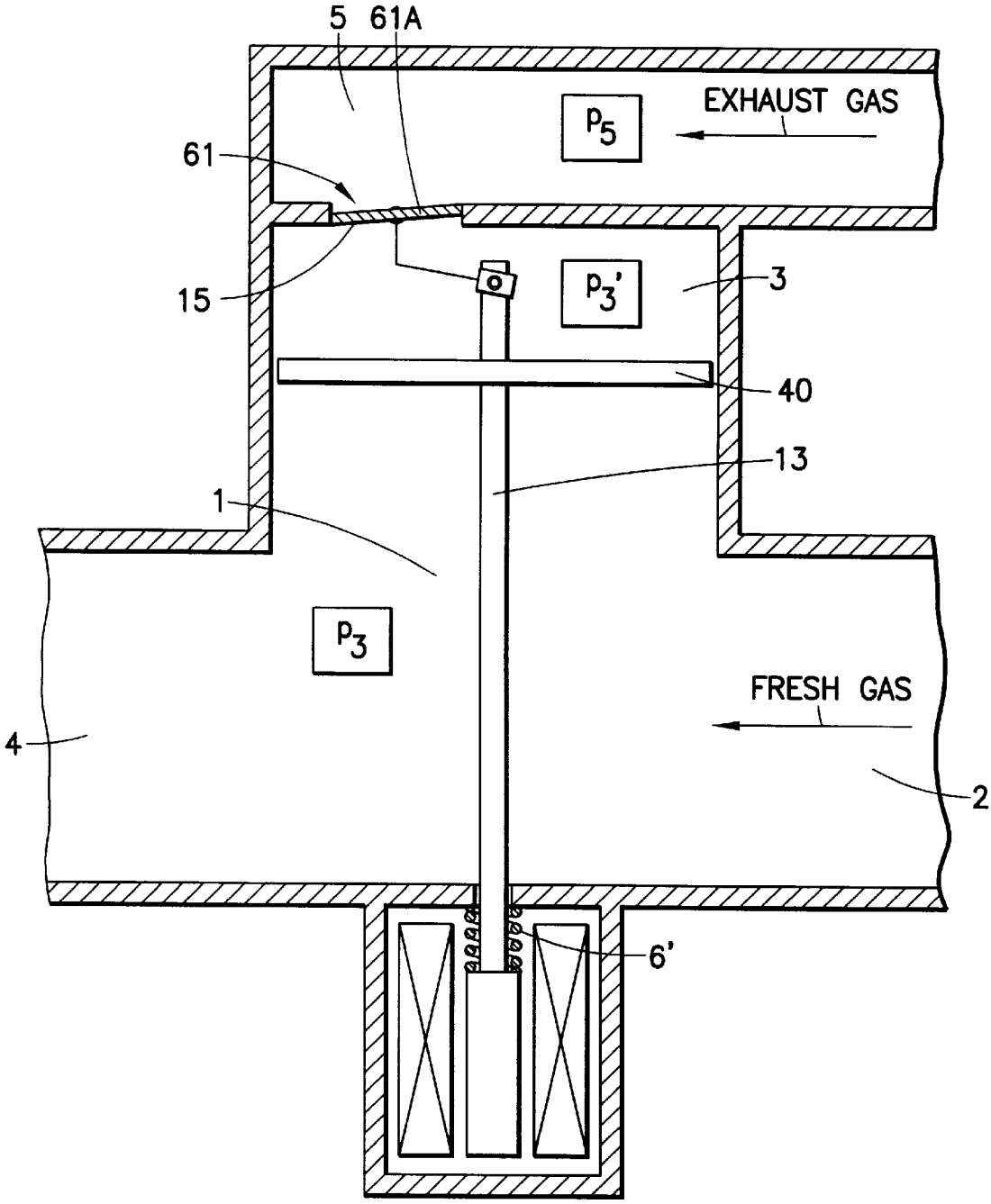
FIG. 2 shows a schematic cross-sectional illustration of a further embodiment of the invention having a throttle flap as control means.

A further embodiment of the invention, based on such pressure compensation, is illustrated in FIG. 2. In the simplest way, in this case a throttle flap 61A can be used as a metering or control means 61, being connected to the rod 13 via a lever 15. The advantage here is that the desired pressure compensation is possible with the simplest mechanical design. However, it is disadvantageous that the valve or main valve 61 formed by the throttle flap 61A is not hermetically gastight when it is closed.

Figure 3:
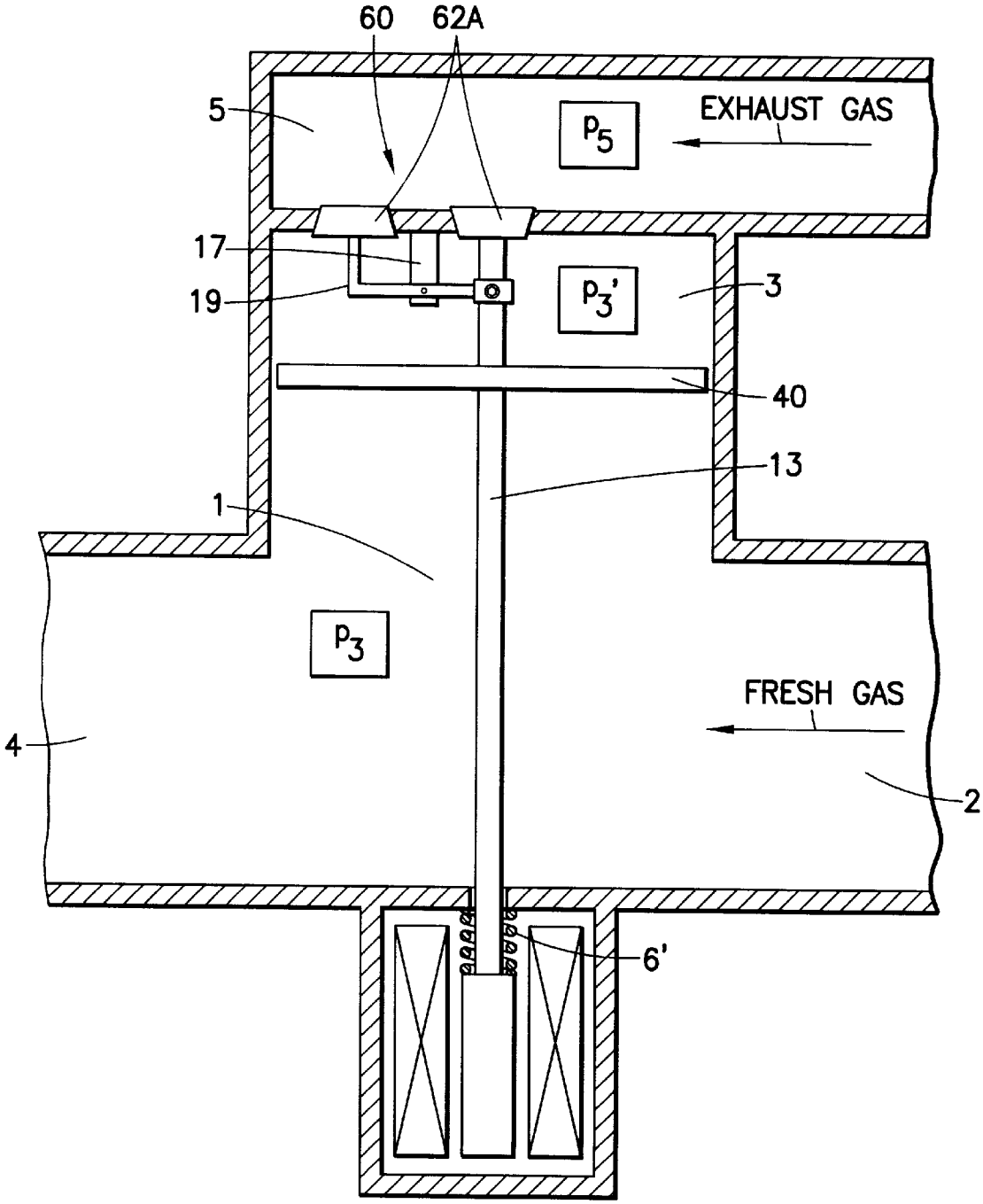
FIG. 3 shows a schematic cross-sectional illustration of a further embodiment of the invention having two oppositely directed valves.

FIG. 3 shows a further embodiment of the invention. In this case, a further possibility for pressure compensation is used, in which a valve disk 62A of a main valve 62 is guided on a circular arc in the exhaust gas flow direction, and a further valve disk 62 is guided linearly but in the direction opposite to the exhaust gas flow direction. In this case, one of the valve disks 62A is fixed to an L-shaped lever 19, which is connected to the rod 13 such that it can pivot, the lever 19 being mounted so that it can pivot at its center on a stationary projection 17 from the wall. The other valve disk 62A is fixed at the upper end of the rod 13. The arrangement of the lever 19 and the areas of the valve disk 62A which are effective for the gas pressure are in this case selected such that the forces acting on the rod 13 on account of the pressure gradient between the exhaust gas feed 5 and the chamber 3 are compensated for. Instead of using circular paths and a linear valve-disk guide, two linear valve-disk guides or two circular-path guides are also possible.

Figure 4:
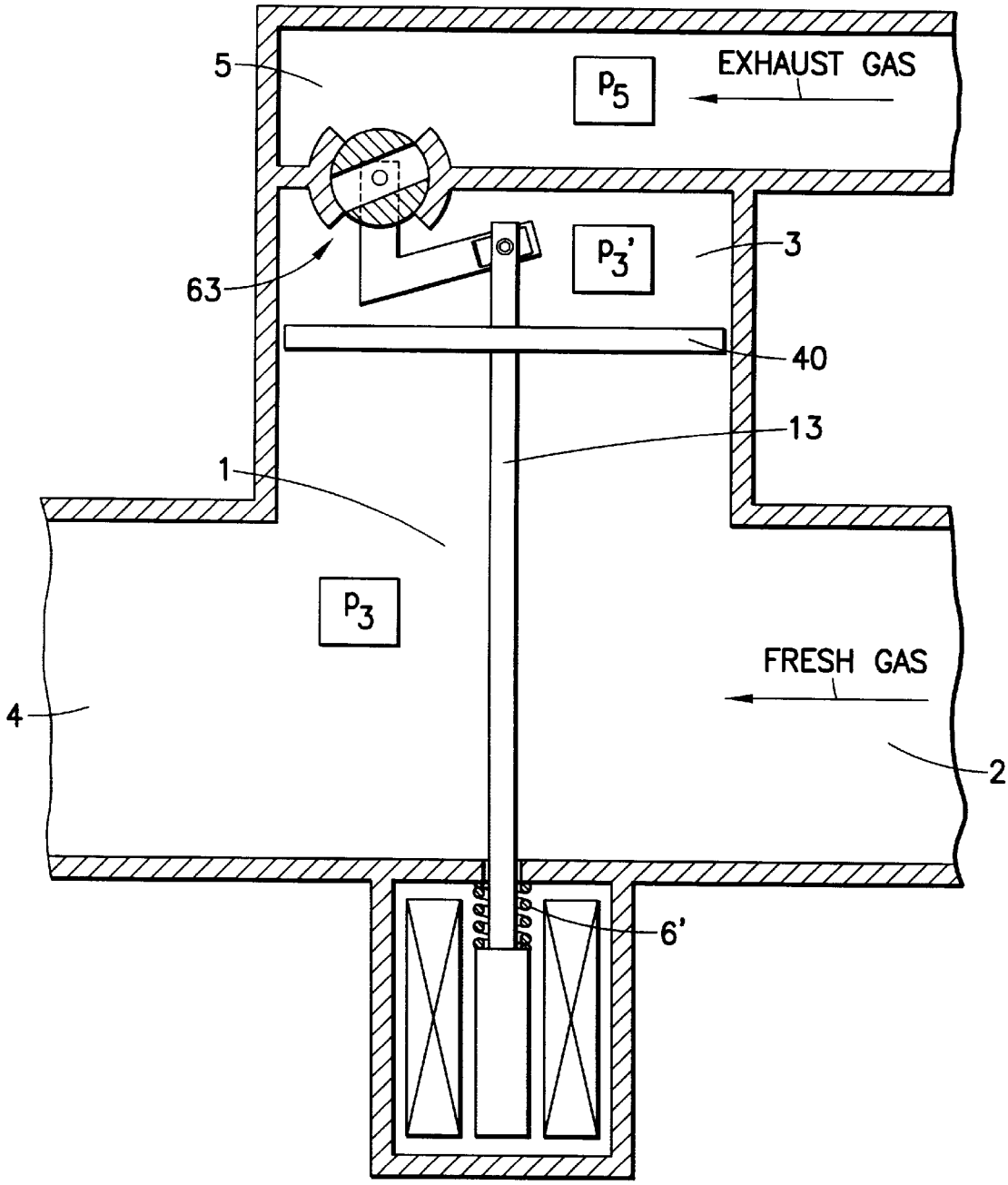
FIG. 4 shows a schematic cross-sectional illustration of a further embodiment of the invention having a ball, conical or cylindrical valve.

FIG. 4 shows a further embodiment of the invention, similar to FIG. 2, in which the main valve provided is a ball valve, conical valve or cylindrical valve 63, in order to permit the desired pressure compensation.

Figures 5, 5A:
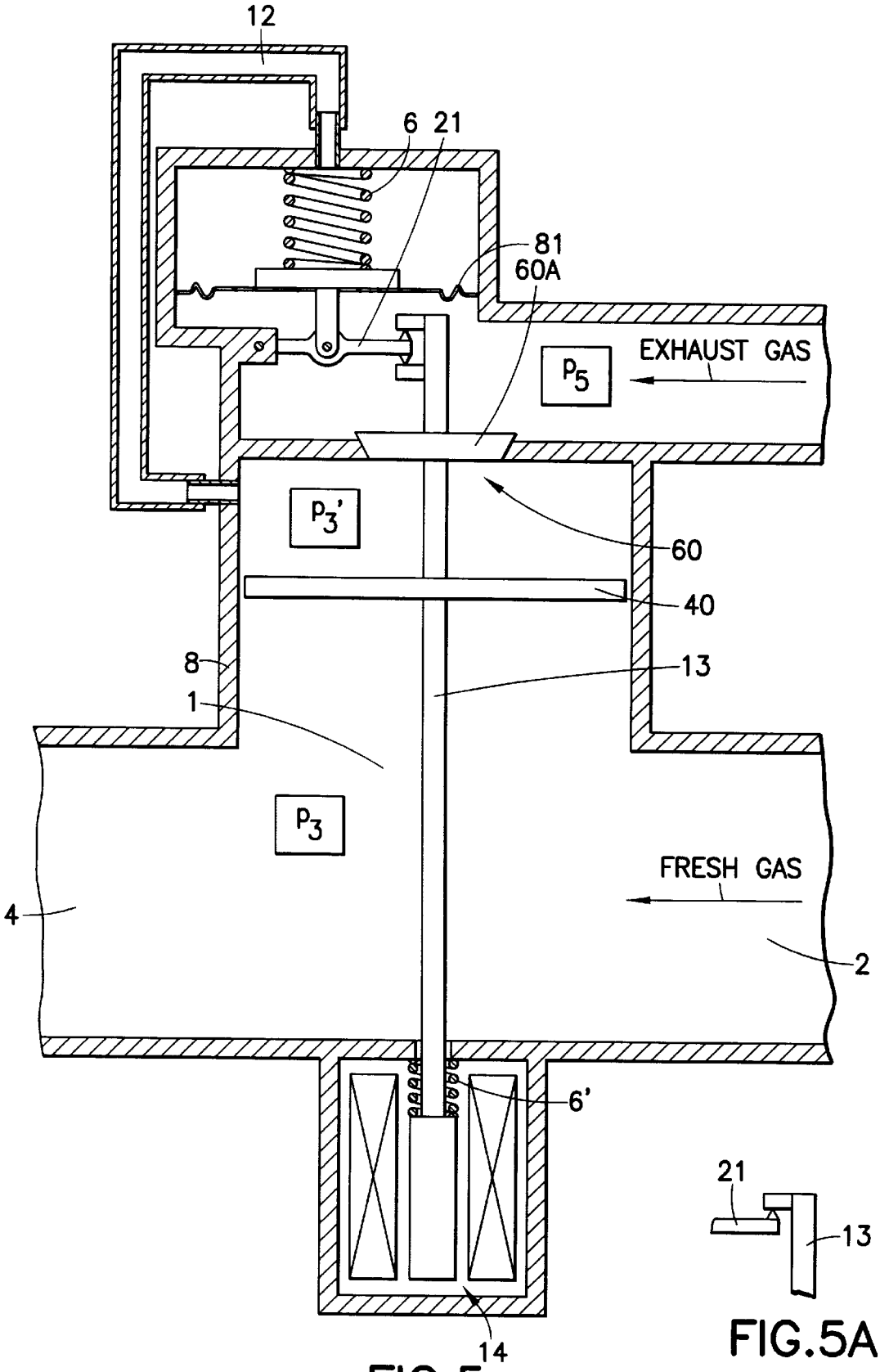
FIGS. 5 and 5A show a schematic cross-sectional illustration of a further embodiment of the invention having a diaphragm and a lever transmission.

FIGS. 5 and 5A show a further embodiment of the invention which attempts to overcome the disadvantages of the embodiment described with reference to FIG. 1 and having the piston 80. In the embodiment described with reference to FIG. 1, completely mechanically friction-free operation of the piston 80 is not possible and, when the main valve 60 is closed, there can still be a connection between the exhaust gas feed 5 and the junction 1, so that exhaust gas can still flow to the intake side of the engine. This can be prevented by the piston 80 being replaced by a diaphragm 81 which has an identical or different effective area or cross section to that of the piston 80. If the effective area $F_{81}$ of diaphragm 81 is different, for example grater, a step up or step down must be provided between the diaphragm 81 and the rod 13. in the embodiment of FIG. 5, there is a lever transmission having a lever arm 21 which is mounted on one side such that it can pivot on a projection on the wall 8 and which can be brought into engagement with the rod 13 on both sides (FIG. 5) or on one side (FIG. 5A). The compensation force which is produced on account of the pressure gradient across the diaphragm 81 is transmitted to the rod 13, in accordance with the predetermined transmission ratio, using a compensation arm which, on one side, is connected to the diaphragm 81 and, on the other side, is connected so that it can pivot to the lever arm 21. In the case of the single-sided engagement according to FIG. 5A, the lever arm 21 is able to carry along the rod 13 only in the opening direction of the main valve 60, that is to say there is single-sided decoupling between the diaphragm 81 and the main valve 60. In this way, the greater force $F_{81}\times p_5$ is stepped down to the old compensation force of the piston $F_{80}\times p_5$.

A corresponding embodiment with a lever transmission is also to be recommended in embodiments with pistons, if the effective areas of the latter differ from those of the main valve. A kinematic lever system is particularly expedient in the case of diaphragms, which as a rule can only make relatively small reciprocating movements.

Figure 6:
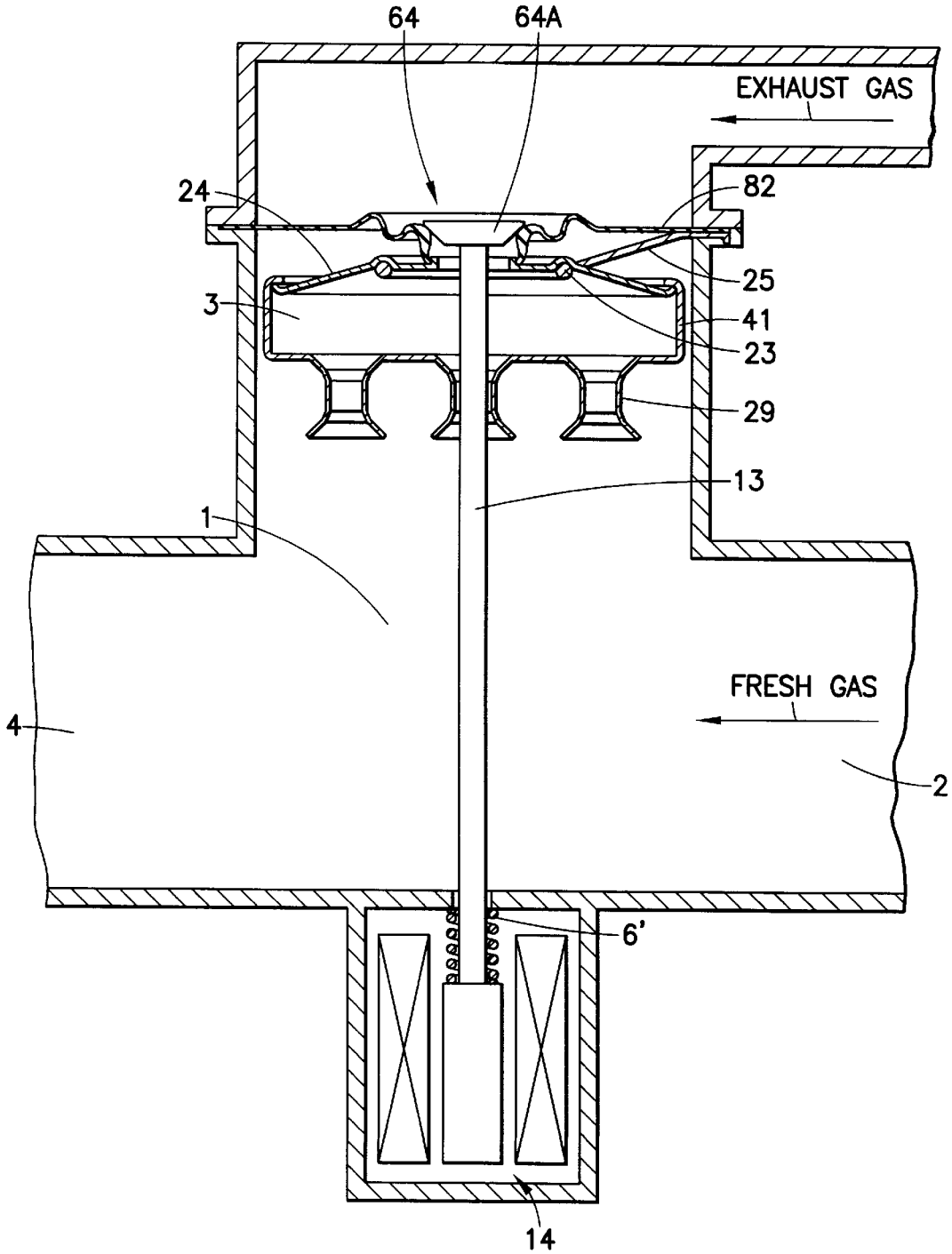
FIG. 6 shows a schematic cross-sectional illustration of a further embodiment of the invention having a diaphragm and a lever transmission.
Figure 7:
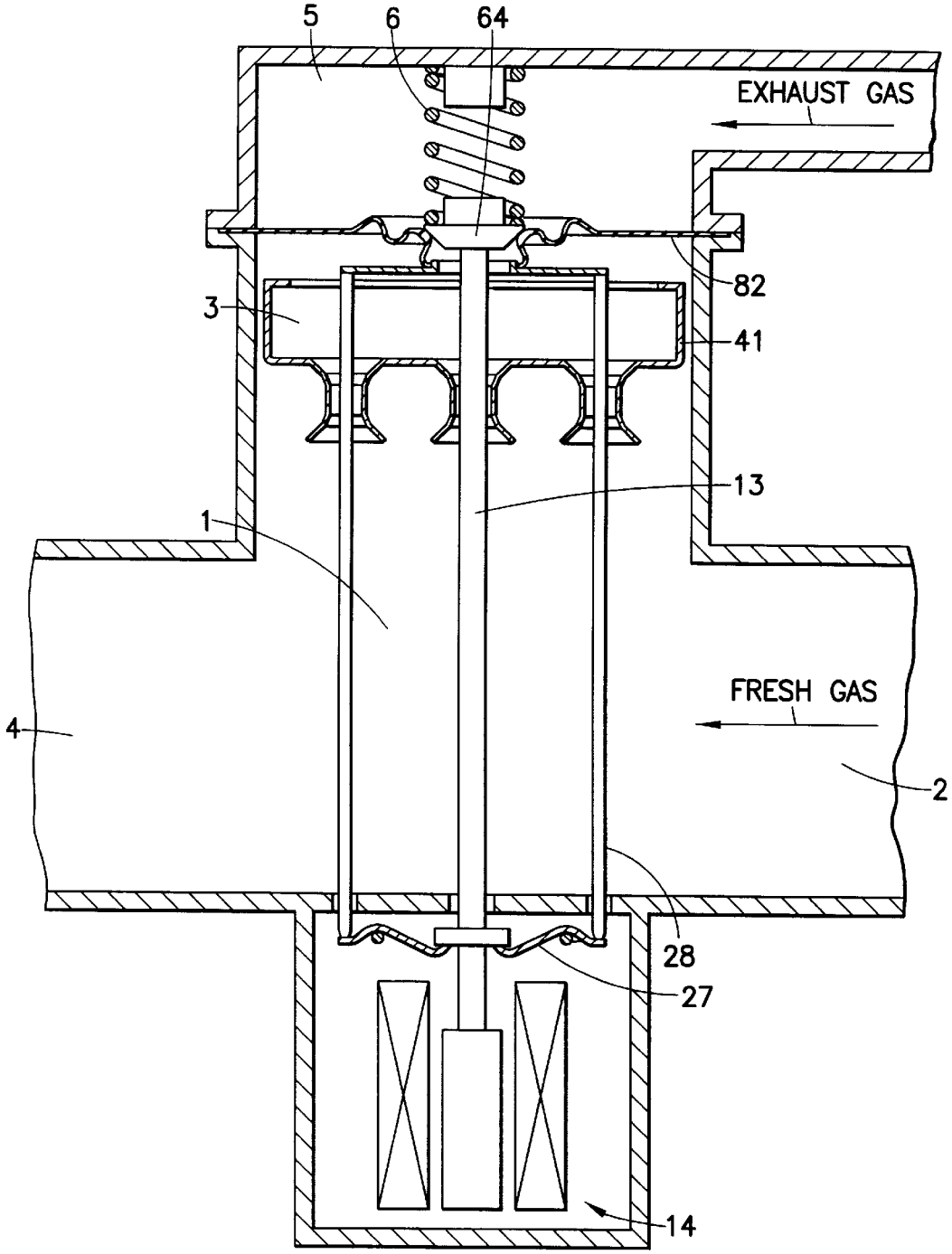
FIG. 7 shows a schematic cross-sectional illustration of a further embodiment of the invention having a diaphragm and a lever transmission.

FIGS. 6 and 7 show further embodiments of the invention. In this case, in order to achieve advantages in terms of overall space and savings in costs and to eliminate possible causes of damage, an embodiment is proposed which manages without the line 12 of the embodiment described with reference to FIG. 1. Instead of the wall 60B bearing the valve seat, in this case a diaphragm 82 is provided which separates the exhaust gas feed 5 from the chamber 3. In this case, a valve seat of a valve disk 64A of a main valve 64 is formed in the diaphragm 82. The exhaust gas to be recirculated flows through a hollow pressure-plate body or around the pressure plate 41 in the direction of the junction 1.

In the embodiment of FIG. 6, a pivot 23 for a lever transmission 24 is rigidly connected to the stationary pipelines via a star 25.

In the embodiment illustrated in FIG. 7, the levers 27, which are mounted such that they can rotate, are actuated by rods 28 which, because of the gas resistance in the junction 1, are expediently located upstream and downstream of the rod 13 in the flow direction from the fresh gas feed 2 to the outlet duct 4. Here, the lever mechanism 27 is removed from the area which is flushed by exhaust gas, because of the risk of contamination and corrosion and on temperature grounds. The stepped-up compensation force is again transmitted via the rod 13 to the valve disk of the main valve 64 and leads to the balancing of the force components to be compensated for.

Figure 8:
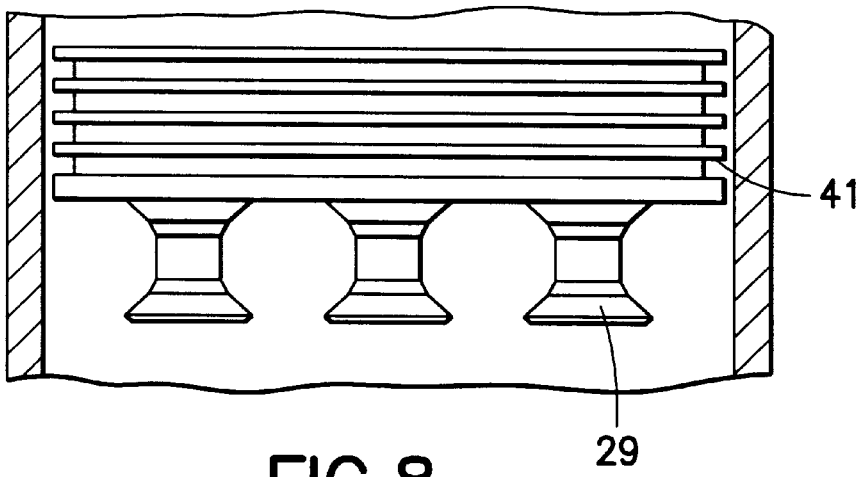
FIG. 8 shows a schematic cross-sectional illustration of an embodiment of a pressure plate.

FIG. 8 shows an expedient embodiment of the hollow pressure plate or the pressure element 41 which is provided for the embodiments described with reference to FIGS. 6 and 7. For reasons relating to the acoustic, mechanical and fluidic matching, it may be advantageous for as little exhaust gas as possible to pass around the outer edge or outer circumference of this pressure element 41, but to pass mainly through the flow openings or gas passage openings 29 provided for this purpose, which can be designed in the manner of nozzles.

Figure 9:
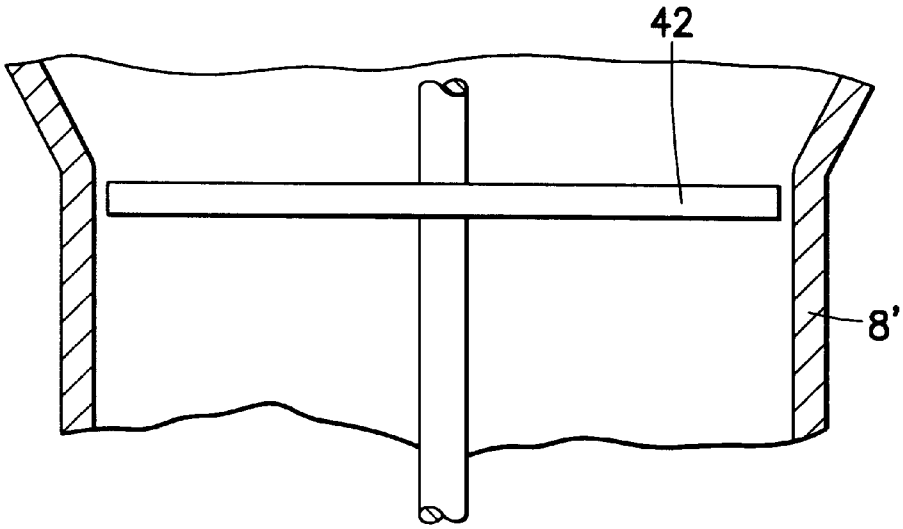
FIG. 9 shows a schematic cross-sectional illustration of a further embodiment of a pressure plate.

FIG. 9 shows that the wall 8' enclosing the pressure plate 42 can also be shaped other than purely cylindrically for reasons of matching.

Figure 10:
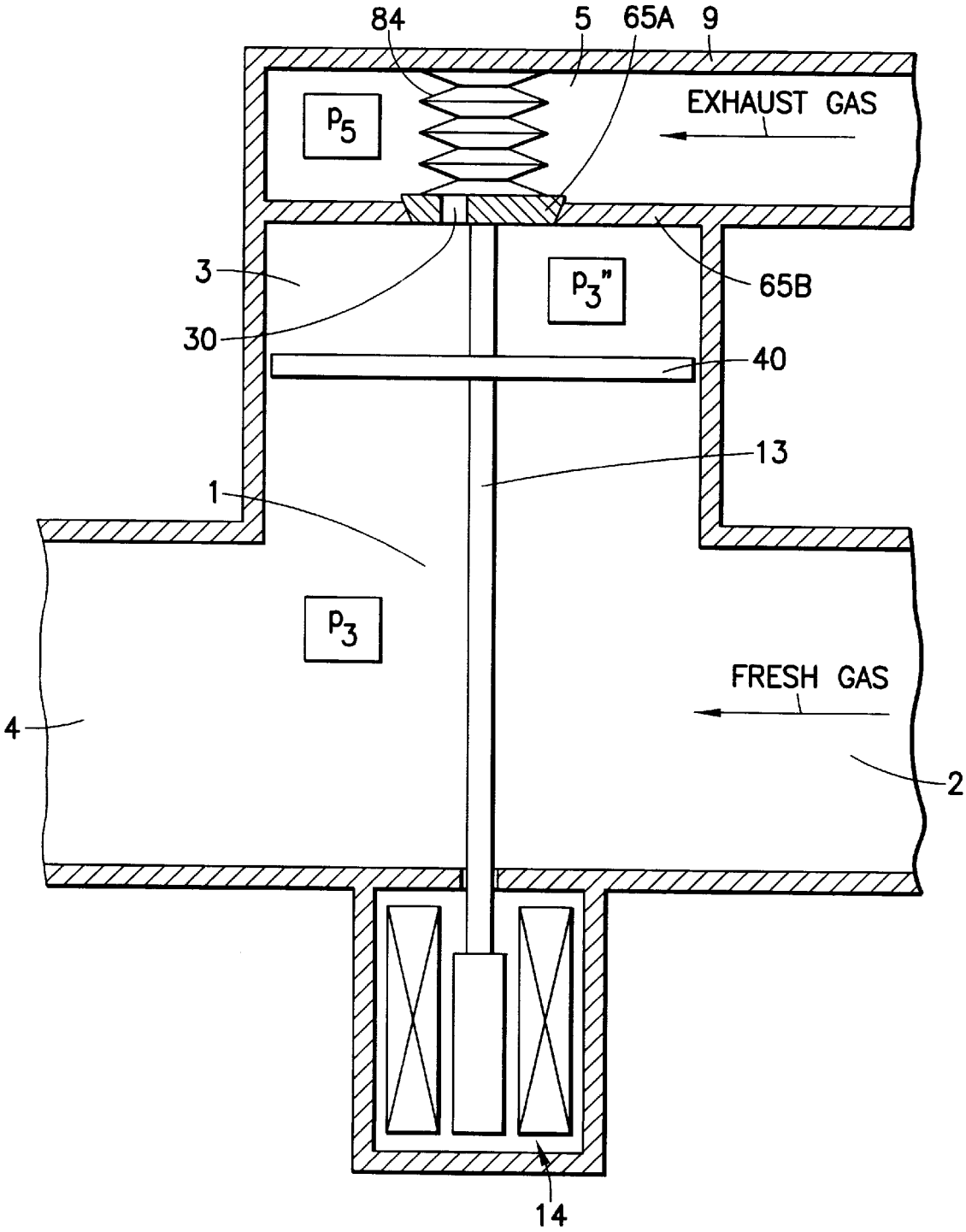
FIG. 10 shows a schematic cross-sectional illustration of a further embodiment of the invention having a bellows.

FIG. 10 shows a further embodiment of the invention. In this case, a bellows 84 is provided in the exhaust gas feed 5, being fixed on its one side to a valve disk 65A of a main valve 65 and, at its other side, opposite in the longitudinal direction, being fixed to the upper wall 9 of the exhaust gas feed 5. The valve disk 65A has a passage opening 30, which connects the chamber 3 to the interior of the bellows 84 in a gas-permeable manner, as a result of which a pressure balance can form between the chamber 3 and the interior of the bellows 84. If the pressure gradient $p_5-p_3'$ increases, the bellows 84 contracts in its longitudinal direction, as a result of which a force is exerted on the valve disk 65A in the opening direction of the main valve 65. The bellows 84 is to be designed in such a way that this force performs the pressure compensation function.

An embodiment of this type can be advantageous if diaphragms with an adequate diaphragm stroke (bellows) are available. For example, low friction and the absence of hysteresis can be achieved in this way; in addition, the bellows 84 can advantageously act at the same time as a closing spring for the main valve 65.

Figure 11:
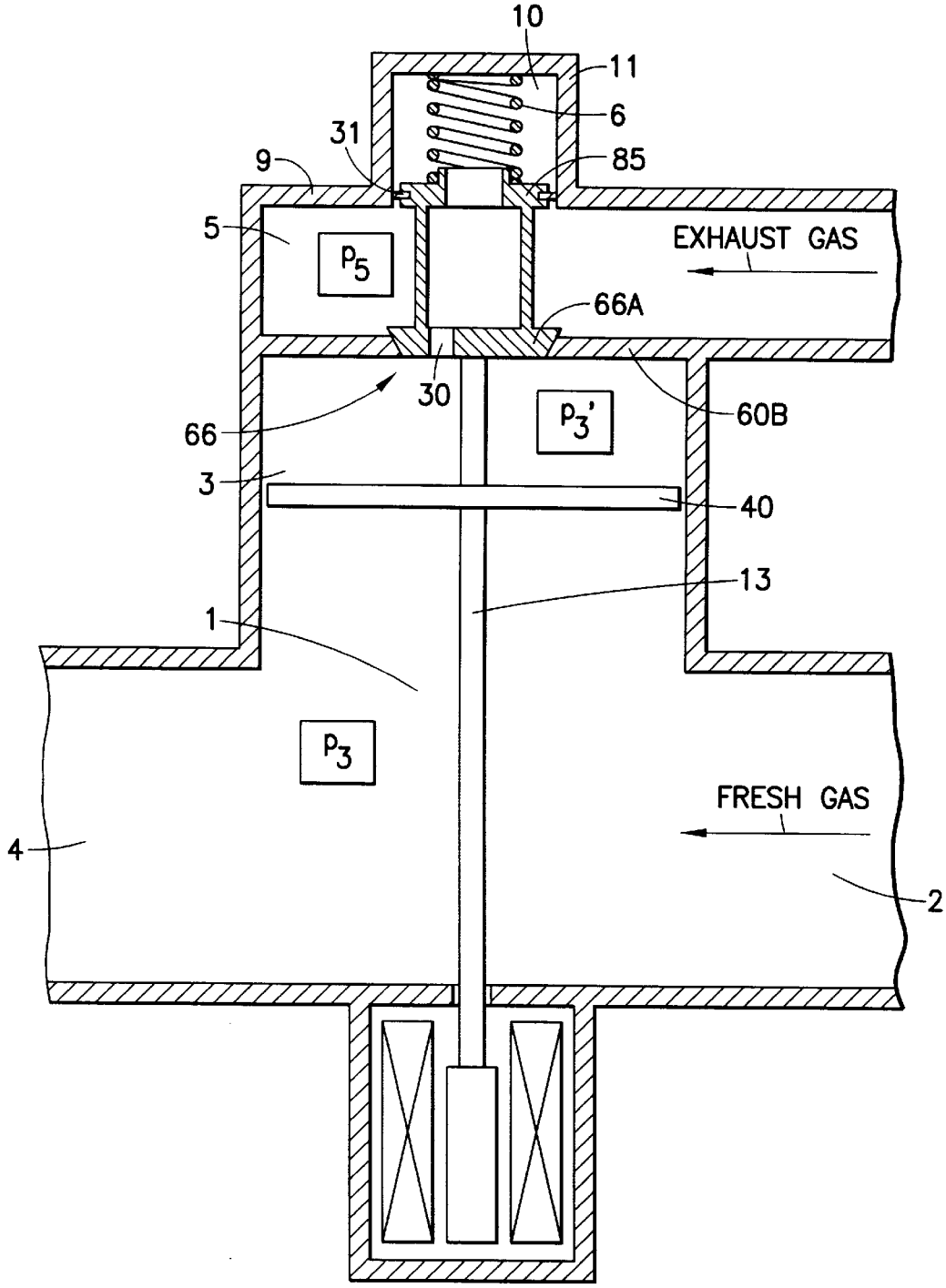
FIG. 11 shows a schematic cross-sectional illustration of a further embodiment of the invention having a piston loaded via a hollow valve body for the purpose of pressure compensation.

An embodiment on this basis, using a piston 85 instead of a bellows, is also possible, as illustrated in FIG. 11. A hollow valve element 66A of a main valve 66 connects the chamber 3 in a gas-permeable way to the compensation chamber 10, which accommodates the piston 85, by which means it is possible to compensate for the force associated with the pressure gradient $p_5-p_3'$. However, in the case of this embodiment the disadvantages of friction and incomplete tightness, specific to a piston, again occur.

Figure 12:
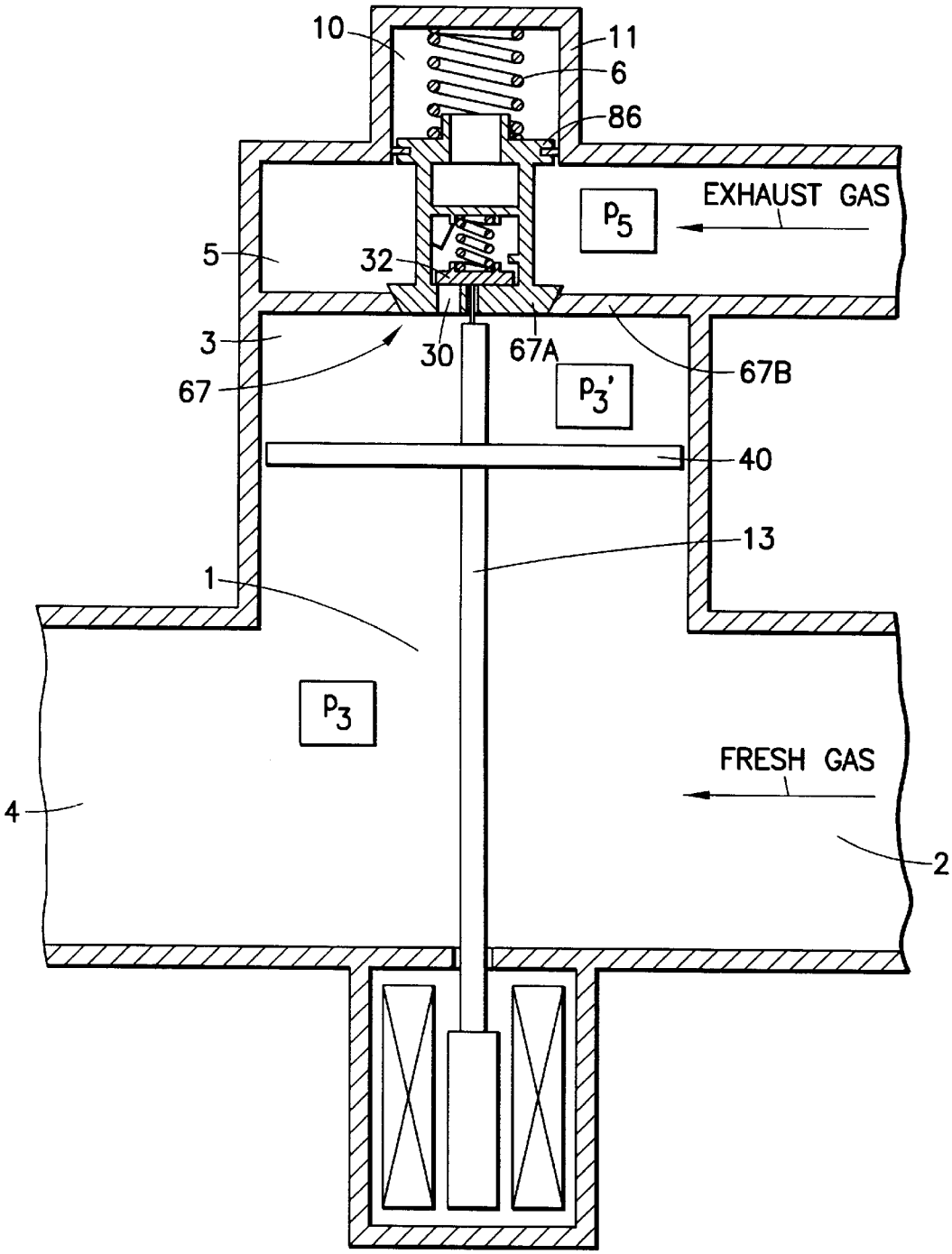
FIG. 12 shows a schematic cross-sectional illustration of a further embodiment of the invention having an additional inner valve.

An embodiment corresponding to FIG. 12 can therefore be advantageous, in which the hermetic seal between the exhaust gas feed 5 and the junction 1 is not produced by a sealing ring 31 on the piston 85, as in FIG. 11, but by an inner valve 32 inside the main valve 67. The inner valve 32 is opened by a pilot stroke of the rod 13, which is brought about by the actuating device, especially by an electromagnet or proportional magnet 14. As long as the inner valve 32 is closed, the pressure gradient $p_5-p_3$ holds the inner valve 32, and therefore the main valve 67, closed. If the inner valve 32 is opened by the pilot stroke, because of a throttling point between the outer circumference of the piston 86 and the wall 11, whose cross section must be small in comparison with the passage opening 30 in the valve element 67A, the result is the pressure $p_3'$ above the piston 86 in the compensation chamber 10, which produces the pressure balance. The pressure balance can be influenced by selecting the diameter ratio of the effective area of the piston 86 to that of the valve disk 67A, and by the ratios between the opening cross sections of the throttling point and the inner valve 32.

Figure 13:
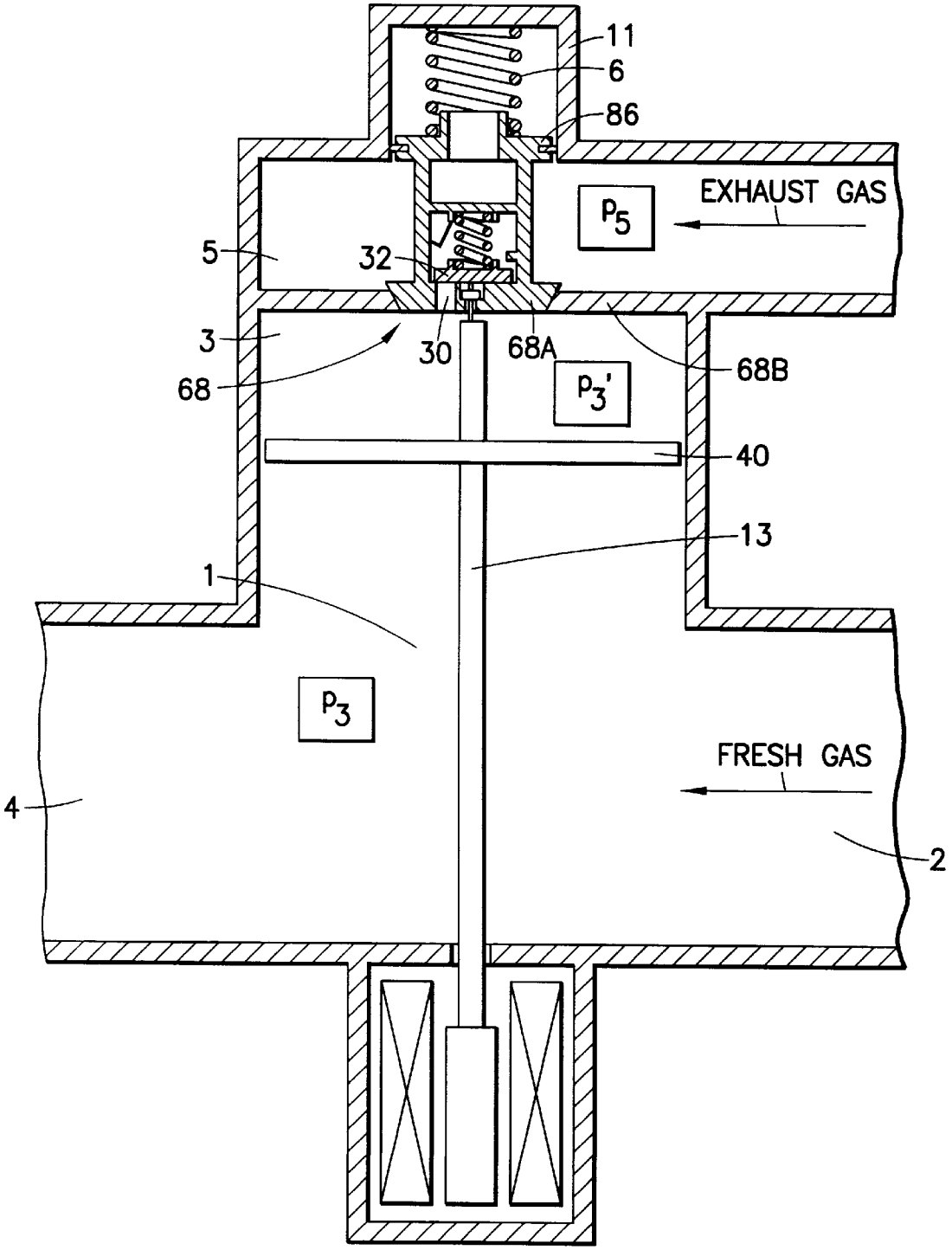
FIG. 13 shows a schematic cross-sectional illustration of a further embodiment of the invention having an additional inner valve.

FIG. 13 shows a further design of the exhaust gas recirculation device having pressure compensation similar to the embodiment illustrated in FIG. 12, with the difference that here the main valve 68 with the valve disk 68A, together with an inner valve 32, is not carried along in the closing direction merely by the spring 6 but also forcibly by the rod 13.

Figure 14:
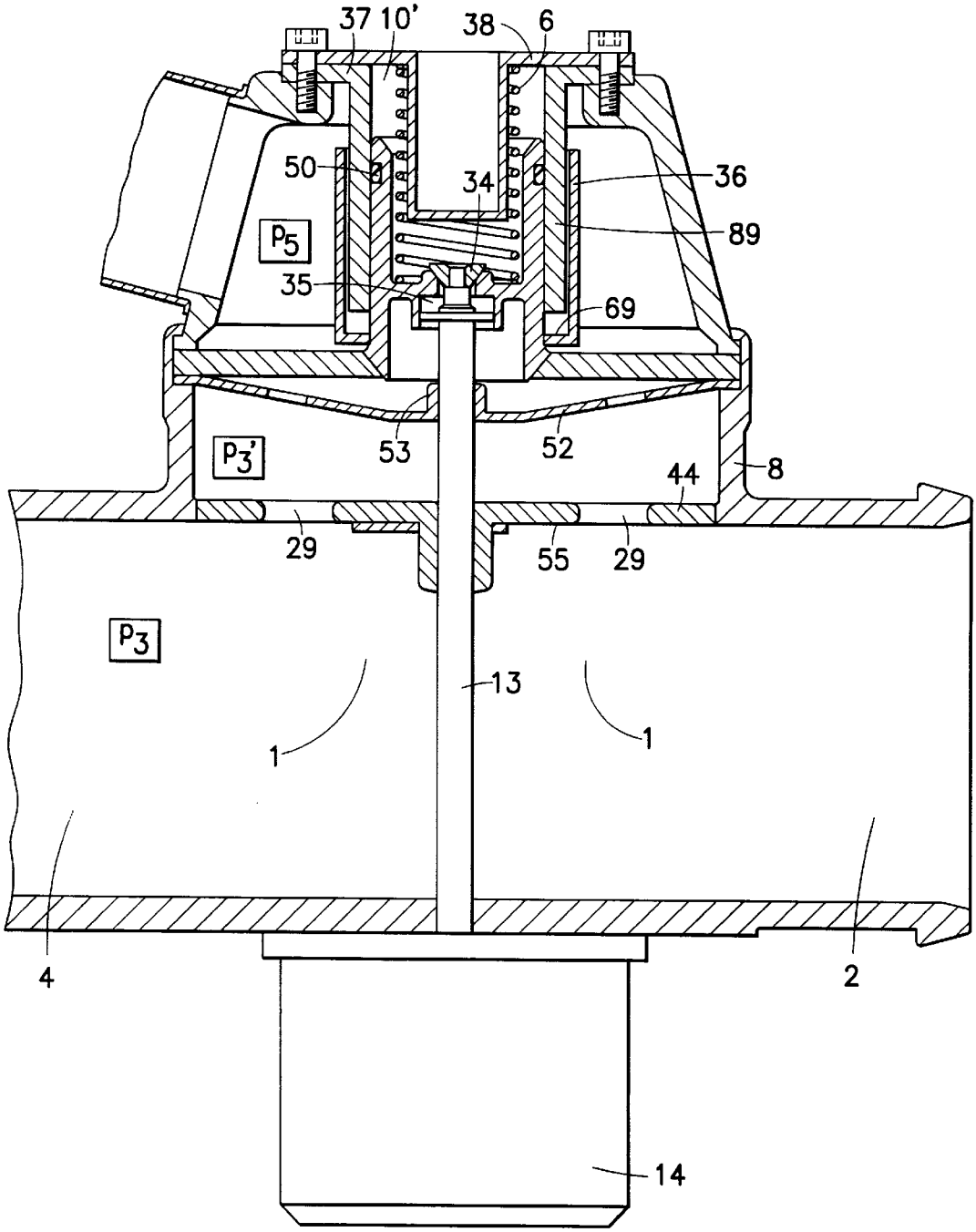
FIG. 14 shows a schematic cross-sectional illustration of a further embodiment of the invention having an additional stationary impact-pressure plate.

FIG. 14 shows a particularly preferred embodiment of the exhaust gas recirculation device having pressure compensation, having an inner valve 34 which is opened during the pilot stroke of the rod 13. The inner valve 34 has a conical or preferably hemispherical valve disk in this case. A pin 35 fixed to the upper area of the rod 13 has the task of lifting a main valve 69 after the pilot stroke in order to open the inner valve 34. Instead of actuating the inner valve in this way via the actuating device 14, it is also optionally possible for an inner-valve actuating device to be provided specifically for actuating the inner valve, this making the independent actuation of the main valve and inner valve possible (not illustrated).

As an option, a protective sleeve or sleeve 36 can be provided, which protects the sliding seat of the piston 89 in a guide sleeve 37 against contamination. A cover 38 is constructed or provided with a separate filling piece in such a way as to make a chamber above the main valve 69, said chamber constituting an inner-valve compensation chamber 10', as small as possible, in order that the respectively desired pressure ($p_5$ in the closed state and $p_3'$ in the open state) builds up as rapidly as possible and as little exhaust gas as possible can enter this inner-valve compensation chamber 10'. The gas pressure in the inner-valve compensation chamber is designated by $p_{10}'$. If it is advantageous for matching and/or to combat contamination, use may be made of a sealing ring 50, which has the effect of a partial gas seal of an opening gap between the piston 89 and the guide sleeve 37. In order to make it easier to thread the piston 89 into the guide sleeve 37, the latter has received a chamfer on its inner diameter at its lower end. An impact-pressure plate 52 is provided in order to eliminate the falsifying action of the impact pressure of the gases flowing from the opening cross section of the main valve 69 onto a pressure plate 44, that is to say the intention is to prevent the exhaust gas stream flowing through the main valve from the exhaust gas feed 5 in the direction of the junction 1 flowing directly onto the pressure plate 44, since this can have an undesired transfer of momentum, with an associated falsifying effect on the control or regulation properties of the exhaust gas recirculation device. It has proven to be particularly advantageous to draw a collar 53 of the impact-pressure plate 52 as high as possible into the main valve 69. In this case, the impact-pressure plate 52 can advantageously simultaneously perform the function of guiding the rod 13 at the top. Guiding the rod 13 at the top in this way is also possible by means of the pressure plate 44, the pin 35, a diaphragm or a bellows.

It has proven to be advantageous to form openings or gas passage openings 29' in the pressure plate 44 as spring-loaded valves as well. Such an embodiment is illustrated in FIG. 14, in which the gas passage openings 29' are covered by sprung tongues 55 with different spring stiffnesses. In this case, the tongues 55 are fixed to one side of the pressure plate 44. A further refinement to the matching is made possible by the number of openings 29' and by selecting the diameter of the gas passage openings 29'.

Figure 15:
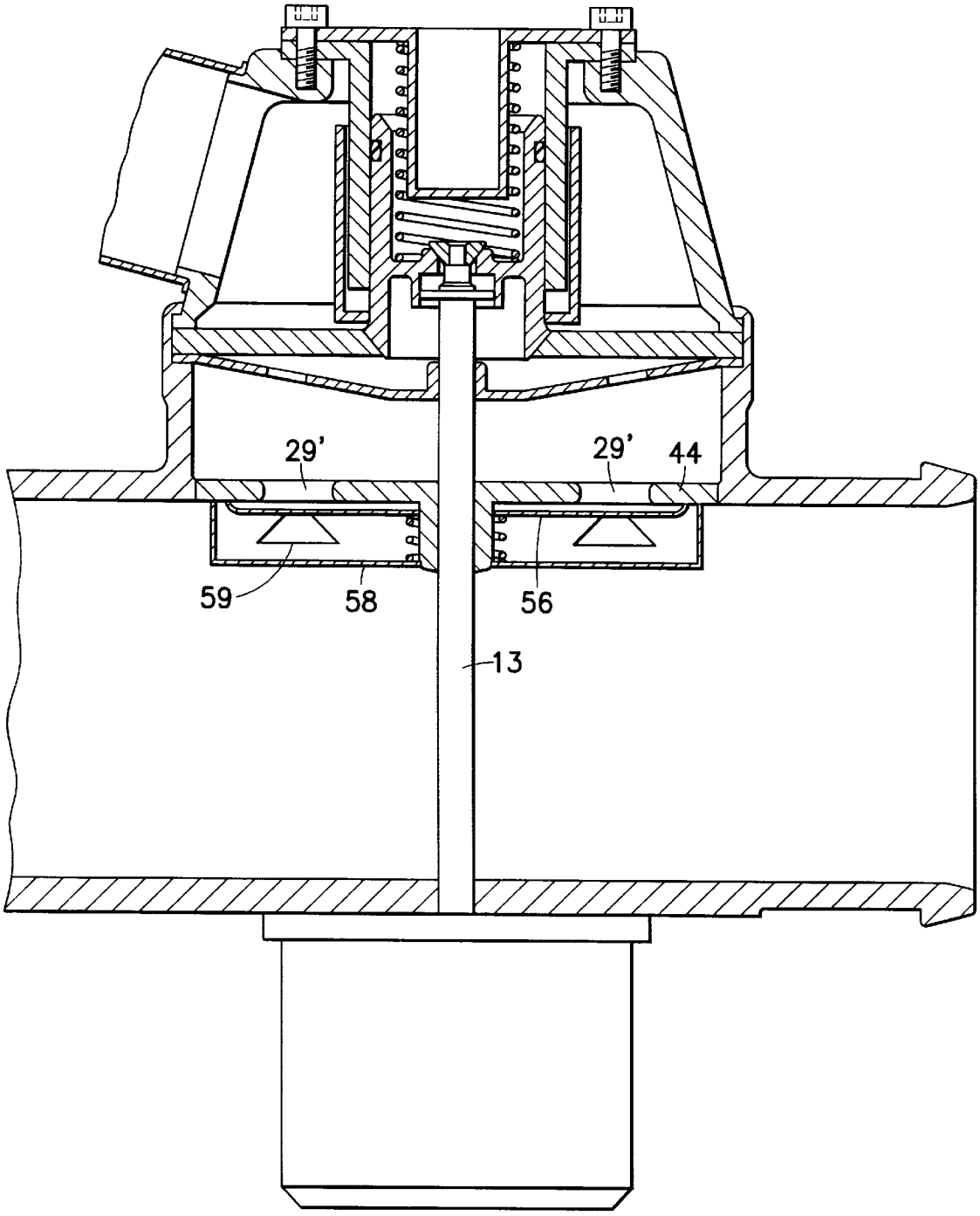
FIG. 15 shows a schematic cross-sectional illustration of a further embodiment of the invention, similar to FIG. 12, having an additional pot.

Also advantageous is an embodiment in which the gas passage openings 29' are selected to be sufficiently large from the beginning and are closed by a spring-loaded plate or sealing plate 56 which seals at its rim, as shown in the embodiment illustrated in FIG. 15. The sealing plate 56 opens more or less into a pot 58 which encloses it, depending on the pressure difference $p_3'-p_3$, opening elongate openings or passages 59 whose opening characteristic has to be determined during the matching. It is even possible for any desired force/throughput characteristics to be implemented via the shaping of such passages, providing such characteristics remain continuous.

Depending on the matching of the diameter ratios of the pistons and diaphragms or bellows 80–89 to the respective main valves 60–69, it is possible for the valves 60, 64, 65, 66, 67, 68, 69 to open in the event of pressures $p_3>p_5$ which can occur, for example, in the case of a positive flushing gradient resulting from a turbocharger or from mechanical supercharging of an engine, and this would lead to losses of charging air. One possibility of counteracting this is to reverse the polarity of the magnet, if a permanent magnet is used as armature, or a corresponding measure, if electric-motor, pneumatic, hydraulic or mechanical actuation of the inner valves is provided as actuating device.

In the embodiments shown beginning at FIG. 12, another possibility is simply to open the inner valve 32 or 34 via the magnet or the corresponding actuating device at such operating points. The pressure $p_3$, which is higher than $p_5$, would then be present above the main valve 67 to 69, in the chamber 3, and above the piston 86 or 89, so that the main valve 67 to 69 could be closed by a spring, for example. The slight loss of charging air via a throttling point between guide sleeve 11 or 37 and piston 86 or 89 is manageable.

LIST OF REFERENCE SYMBOLS

1. Junction

2. Fresh gas feed

3. Chamber
4. Outlet duct
5. Exhaust gas feed
6. Spring
6'. Spring
8. Wall
8'. Wall
9. Wall
10. Compensation chamber
11. Upper wall
12. Compensation line
12A. Compensation line
13. Rod
14. Magnet or proportional magnet
15. Lever
17. Projection from the wall
19. Lever
21. Lever arm
23. Pivot
24. Lever transmission
25. Star
27. Lever
28. Rods
29. Gas passage openings
29'. Gas passage openings
30. Through opening
31. Sealing ring
32. Inner valve
33. Inner valve
34. Inner valve
35. Pin
36. Protective sleeve
37. Guide sleeve
38. Cover
40. Pressure plate
41. Pressure element
42. Pressure plate
44. Pressure plate
50. Sealing ring
52. Impact-pressure plate
53. Collar
55. Tongues
56. Sealing plate
58. Pot
59. Openings
60. Main valve
60A. Valve plate
60A'. Valve plate
60B Valve seat or wall
61. Main valve
61A. Throttle flap
62–69. Main valve
62A–69A. Valve plates
80. Piston
81–82. Diaphragm
84. Bellows
85. Piston
87–89. Piston

What is claimed is:

1. An exhaust gas recirculation device for recirculating exhaust gas into a gas feed to engines, said device having an exhaust gas feed, a fresh gas feed and an outlet duct opening into the gas feed, at least the exhaust gas feed and the fresh gas feed being interconnected via a control means having an adjustable free opening cross-section for metering exhaust gas, and a pressure plate disposed on a side of the control means facing the fresh gas feed for minimizing influence of pressure fluctuations that occur on a side of the control means facing the exhaust gas feed and on the side of the control means facing the fresh gas feed by adjusting the free opening cross-section of the control means and thereby having an effect on the exhaust gas throughput.

2. The exhaust gas recirculating device as claimed in claim 1, where the control means can be actuated by a mechanical, pneumatic, hydraulic, magnetic or electric actuating device.

3. An exhaust gas recirculation device for recirculating exhaust gas into a gas feed to an engine, said device having an exhaust gas feed, a fresh gas feed and an outlet duct opening into the gas feed, at least the exhaust gas feed and the fresh gas feed being interconnected via a control means for metering exhaust gas, a pressure plate disposed on a side of the control means facing the fresh gas feed for minimizing influence of pressure fluctuations that occur on the exhaust gas side and the fresh gas side and having an effect on exhaust gas throughput, the control means being actuated by a mechanical, pneumatic, hydraulic, magnetic or electric actuating device and a compensation device in the form of a diaphragm or a bellows to compensate for forces which act on the control means on account of a pressure difference between gas pressures on the exhaust gas side and the fresh gas side.

4. The exhaust gas recirculation device as claimed in claim 3, where one side of the compensation device is loaded by the gas pressure on the exhaust gas side, and the other side of the compensation device is loaded by the gas pressure on the fresh gas side.

5. The exhaust gas recirculation device as claimed in claim 3, where a gas pressure in an inner valve compensation chamber is controlled by interaction of an inner valve with an opening gap between the piston and a guide sleeve of the piston, the inner valve being actuated by at least one of the actuating device and an inner-valve actuating device.

6. The exhaust gas recirculation device as claimed in claim 4, wherein the compensation device acts on the control means via a kinematic transmission lever transmission to compensate for a difference between areas of the control means which are effective for the gas pressure, on the one hand, and the compensation device on the other hand.

7. The exhaust gas recirculation device as claimed in claim 6, wherein the compensation device, the control means and the pressure plate are interconnected in terms of the action of force and are controllable via the actuating device.

8. An exhaust gas recirculation device for recirculating exhaust gas into a gas feed to an engine, said device having an exhaust gas feed, a fresh gas feed and an outlet duct opening into the gas feed, at least the exhaust gas feed and the fresh gas feed being interconnected via a control means for metering exhaust gas, a pressure plate disposed on a side of the control means facing the fresh gas feed for minimizing influence of pressure fluctuations that occur on the exhaust gas side and the fresh gas side and having an effect on exhaust gas throughput, and a stationary impact-pressure plate disposed to prevent an exhaust gas stream flowing out of the control means from flowing directly onto the pressure plate.

9. An exhaust gas recirculation device for recirculating exhaust gas into a gas feed to an engine, said device having an exhaust gas feed, a fresh gas feed and an outlet duct opening into the gas feed, at least the exhaust gas feed and the fresh gas feed being interconnected via a control means for metering exhaust gas, a pressure plate disposed on a side of the control means facing the fresh gas feed for minimizing influence of pressure fluctuations that occur on the exhaust gas side and the fresh gas side and having an effect on exhaust gas throughput, the control means being prestressed in a closed direction by spring action of a diaphragm or a bellows.

10. An exhaust gas recirculation device for recirculating exhaust gas into a gas feed to an engine, said device having an exhaust gas feed, a fresh gas feed and an outlet duct opening into the gas feed, at least the exhaust gas feed and the fresh gas feed being interconnected via a control means for metering exhaust gas, a pressure plate disposed on a side of the control means facing the fresh gas feed for minimizing influence of pressure fluctuations that occur on the exhaust gas side and the fresh gas side and having an effect on exhaust gas throughput, and the pressure plate being designed and arranged such that the gas essentially flows through openings in the pressure plate and as little gas as possible flows around an outer circumference of the pressure plate.

11. An exhaust gas recirculation device for recirculating exhaust gas into a gas feed to an engine, said device having an exhaust gas feed, a fresh gas feed and an outlet duct opening into the gas feed, at least the exhaust gas feed and the fresh gas feed being interconnected via a control means for metering exhaust gas, a pressure plate disposed on a side of the control means facing the fresh gas feed for minimizing influence of pressure fluctuations that occur on the exhaust gas side and the fresh gas side and having an effect on exhaust gas throughput, the pressure plate being equipped with additional devices so that, at low exhaust gas throughput rates, the exhaust gas passes only through a narrow gap between the pressure plate and a wall of the fresh gas side, but, with increasing pressure differences, additional gas passage openings are opened.

* * * * *